US011871827B2

(12) United States Patent
Kuzia et al.

(10) Patent No.: US 11,871,827 B2
(45) Date of Patent: Jan. 16, 2024

(54) HAIR DRYER ASSEMBLY HAVING HAIR RECEIVING CHANNEL

(71) Applicant: Spectrum Brands, Inc., Middleton, WI (US)

(72) Inventors: Jay William Kuzia, Madison, WI (US); Michael John deGrood, Madison, WI (US)

(73) Assignee: SPECTRUM BRANDS, INC., Middleton, WI (US)

( * ) Notice: Subject to any disclaimer, the term of this patent is extended or adjusted under 35 U.S.C. 154(b) by 0 days.

(21) Appl. No.: 18/052,054

(22) Filed: Nov. 2, 2022

(65) Prior Publication Data

US 2023/0284763 A1 Sep. 14, 2023

Related U.S. Application Data

(63) Continuation of application No. 17/061,284, filed on Oct. 1, 2020, now Pat. No. 11,510,471.

(60) Provisional application No. 62/978,051, filed on Feb. 18, 2020.

(51) Int. Cl.
*A45D 20/12* (2006.01)

(52) U.S. Cl.
CPC ..... *A45D 20/12* (2013.01)

(58) Field of Classification Search
CPC ..... A45D 20/12
USPC ..... 34/95–100
See application file for complete search history.

(56) References Cited

U.S. PATENT DOCUMENTS 1,821,525 A * 9/1931 Nielsen ..... A45D 20/12 392/385
3,747,212 A 7/1973 Krayl
4,122,329 A * 10/1978 Godel ..... H05B 3/16 219/541
4,409,998 A 10/1983 Bauer
6,148,537 A * 11/2000 Altamore ..... A45D 20/10 34/97

(Continued)

FOREIGN PATENT DOCUMENTS

CN 105415405 A 3/2016
CN 106263451 A 1/2017

(Continued)

OTHER PUBLICATIONS

PCT International Search Report and Written Opinion for Application PCT/US/2020/053127 dated Mar. 1, 2021; 15 pp.

*Primary Examiner* — Stephen M Gravini
(74) *Attorney, Agent, or Firm* — Armstrong Teasdale LLP

(57) ABSTRACT

An attachment for a hair dryer configured to receive airflow from the hair dryer and redirect the airflow generally includes a connector housing extending along an axis, an inlet end, an outlet end, and a channel wall. The inlet end defines an inlet for the airflow to enter the attachment in a first direction parallel to the axis of the connector housing. The outlet end defines a slot-shaped outlet for the airflow to exit the attachment in a direction not parallel to the first direction. The channel wall defines a hair receiving channel and extends at least partly around the hair receiving channel such that hair within the hair receiving channel is contacted by the channel wall, wherein the channel wall extends downflow from the outlet end in a direction not parallel to the first direction and is configured to direct the airflow along a length of hair within the hair receiving channel.

16 Claims, 18 Drawing Sheets

(56) References Cited

U.S. PATENT DOCUMENTS

| | | | | |
|---|---|---|---|---|
| 6,782,636 | B2 | 8/2004 | Feldman | |
| 2,027,694 | A1 | 12/2004 | Jewell | |
| 7,093,376 | B2 | 8/2006 | Regen | |
| 7,465,904 | B2 | 12/2008 | Kim et al. | |
| 7,954,243 | B2 | 6/2011 | De Wit et al. | |
| 8,024,862 | B2 | 9/2011 | Morisugi et al. | |
| 8,066,017 | B1 | 11/2011 | Born et al. | |
| 8,146,254 | B2 | 4/2012 | Morisugi et al. | |
| 8,881,423 | B2 | 11/2014 | Ragosta et al. | |
| 8,915,256 | B2 | 12/2014 | Klava | |
| 9,012,813 | B2 | 4/2015 | Mourad | |
| 9,144,286 | B2 * | 9/2015 | Courtney | A45D 20/12 |
| 9,149,103 | B2 | 10/2015 | Yoe | |
| 9,439,493 | B2 | 9/2016 | Hada | |
| 9,516,938 | B2 | 12/2016 | Richmond et al. | |
| 9,554,634 | B2 | 1/2017 | Yoe | |
| 9,629,434 | B2 | 4/2017 | De Benedictis et al. | |
| 9,770,836 | B2 | 9/2017 | Werner | |
| 9,788,625 | B2 | 10/2017 | De Benedictis et al. | |
| 9,815,215 | B2 | 11/2017 | Uit De Bulten et al. | |
| 9,854,893 | B2 | 1/2018 | Robinson | |
| 9,993,928 | B2 | 6/2018 | Sablatschan | |
| D829,378 | S | 9/2018 | Parker et al. | |
| D836,836 | S | 12/2018 | Parker et al. | |
| 10,165,843 | B2 | 1/2019 | Hedges | |
| 10,322,517 | B2 | 6/2019 | Werner | |
| 10,655,914 | B2 | 5/2020 | Seehausen, Jr. | |
| 10,835,007 | B2 | 11/2020 | deGrood et al. | |
| 10,856,638 | B2 | 12/2020 | Paliobeis et al. | |
| 11,229,269 | B2 | 1/2022 | Tucker | |
| 11,425,980 | B2 * | 8/2022 | Conrad | A45D 20/124 |
| 11,510,471 | B2 * | 11/2022 | Kuzia | A45D 20/12 |
| 11,576,474 | B2 * | 2/2023 | Kim | A45D 20/122 |
| 11,633,028 | B2 * | 4/2023 | Kim | A45D 20/122 34/97 |
| 11,647,822 | B2 * | 5/2023 | Kim | A45D 20/122 34/97 |
| 2006/0191554 | A1 | 8/2006 | Lafuente | |
| 2013/0111777 | A1 * | 5/2013 | Jeong | A45D 20/12 34/97 |
| 2014/0053426 | A1 | 2/2014 | Ragosta et al. | |
| 2014/0290087 | A1 | 10/2014 | Weatherly | |
| 2015/0189967 | A1 | 7/2015 | McNeely et al. | |
| 2017/0231359 | A1 | 8/2017 | Taylor | |
| 2018/0140070 | A1 | 5/2018 | Hillebrecht et al. | |
| 2018/0146762 | A1 | 5/2018 | French-Jackson | |
| 2019/0183223 | A1 | 6/2019 | Parrotto | |
| 2019/0255718 | A1 | 8/2019 | Werner | |
| 2019/0357654 | A1 | 11/2019 | MacPherson et al. | |
| 2021/0251363 | A1 | 8/2021 | Kuzia et al. | |

FOREIGN PATENT DOCUMENTS

| | | | | |
|---|---|---|---|---|
| CN | 106572731 | A | 4/2017 | |
| CN | 206105916 | U | 4/2017 | |
| CN | 206548061 | U | 10/2017 | |
| CN | 206586557 | U | 10/2017 | |
| CN | 207172155 | U | 4/2018 | |
| CN | 208228558 | U | 12/2018 | |
| CN | 208259286 | U | 12/2018 | |
| CN | 109757848 | A | 5/2019 | |
| CN | 110742383 | A | 2/2020 | |
| CN | 211581875 | U | 9/2020 | |
| DE | 102012210275 | B4 | 8/2017 | |
| EP | 1587392 | B1 | 9/2007 | |
| EP | 2998085 | A1 | 3/2016 | |
| EP | 3206523 | B1 | 12/2018 | |
| EP | 3206524 | B1 | 12/2018 | |
| EP | 3235397 | B1 | 2/2019 | |
| GB | 2579471 | A | 6/2020 | |
| JP | 2016182341 | A | 10/2016 | |
| KR | 20080095788 | A | 10/2008 | |
| KR | 101924788 | B1 | 12/2018 | |
| KR | 101985486 | B1 | 6/2019 | |
| WO | 2004045338 | A2 | 6/2004 | |
| WO | 2013158626 | A | 10/2013 | |
| WO | 2018084540 | A2 | 5/2018 | |
| WO | 2019014454 | A1 | 1/2019 | |
| WO | WO-2021167652 | A1 * | 8/2021 | A45D 20/12 |

* cited by examiner

HAIR DRYER ASSEMBLY HAVING HAIR RECEIVING CHANNEL

CROSS-REFERENCE TO RELATED APPLICATIONS

This application is a continuation of U.S. patent application Ser. No. 17/061,284 filed on Oct. 1, 2020, which claims priority to U.S. Provisional Application No. 62/978,051 filed on Feb. 18, 2020, which are incorporated herein by reference in their entirety.

FIELD OF THE DISCLOSURE

The present disclosure relates generally to hair dryers, and more particularly to a hair dryer assembly having a hair receiving channel.

BACKGROUND OF THE DISCLOSURE

Hair dryers are configured to generate an airflow that is directed towards hair to dry the hair. At least some known hair dryers include a handle that allows a user to hold the hair dryer and position the hair dryer relative to the hair. The hair dryers may include one or more attachments that are connected to an outlet of the hair dryer for redirecting or otherwise processing the airflow before it is directed to the hair. For example, concentrators may be used to direct the airflow towards hair and focus the airflow on portions of the hair. However, it can be difficult for a user to properly position the hair dryer relative to the hair for a styling operation. Moreover, the hair may not stay in a desired position relative to the hair dryer as the airflow moves through the hair. In addition, the airflow may not be evenly distributed across a section of hair and, thus, the hair may not be evenly dried throughout its thickness.

Accordingly, it is desirable to provide a hair dryer assembly that directs airflow evenly towards portions of hair and maintains the hair in position relative to the hair dryer as the hair dryer assembly directs airflow towards the hair.

SUMMARY

In one aspect, an attachment for a hair dryer configured to receive airflow from the hair dryer and redirect the airflow generally includes a connector housing extending along an axis, an inlet end, an outlet end, and a channel wall. The inlet end defines an inlet for the airflow to enter the attachment in a first direction parallel to the axis of the connector housing. The outlet end defines a slot-shaped outlet for the airflow to exit the attachment in a direction not parallel to the first direction. The channel wall defines a hair receiving channel and extends at least partly around the hair receiving channel such that hair within the hair receiving channel is contacted by the channel wall, wherein the channel wall extends downflow from the outlet end in a direction not parallel to the first direction and is configured to direct the airflow along a length of hair within the hair receiving channel.

In another aspect, a hair dryer assembly includes a hair dryer configured to output an airflow and an attachment configured to receive the airflow from the hair dryer. The attachment generally includes a connector housing extending along an axis, an inlet end, an outlet end, and a channel wall. The inlet end defines an inlet for the airflow to enter the attachment in a first direction parallel to the axis of the connector housing. The outlet end defines a slot-shaped outlet for the airflow to exit the attachment in a direction not parallel to the first direction. The channel wall defines a hair receiving channel and extends at least partly around the hair receiving channel such that hair within the hair receiving channel is received and contacted by the channel wall, wherein the channel wall extends downflow from the outlet end in a direction not parallel to the first direction and is configured to direct the airflow along a length of hair within the hair receiving channel.

In yet another aspect, a discharge housing for a hair dryer generally includes a cylindrical connector, an inlet end, an outlet end, a top, a bottom, a hair contact wall, and a pair of opposed sidewalls. The cylindrical connecter is configured to releasably connect to the hair dryer. The inlet end defines an annular inlet extending around the cylindrical connector and configured for the airflow to enter the attachment in a first direction. The outlet end defines an outlet for the airflow to exit the attachment. The top extends between the inlet end and the outlet end, and the bottom is opposite the top and extends between the inlet end and outlet end, wherein the top and the bottom collectively define a cavity and are sloped toward each other along at least a portion of the extension between the inlet end and outlet end such that the cavity has a tapered shape. The hair contact wall extends at least in part downward from the outlet end in a direction not parallel to the first direction. The pair of opposed sidewalls extend along sides of the hair contact wall, the hair contact wall and the sidewalls defining a hair receiving channel and extending at least partly around the hair receiving channel, wherein the hair contact wall is arranged such that hair within the hair receiving channel is contacted by the hair contact wall, wherein the hair contact wall extends downflow from the outlet end and is configured to direct the airflow and along a length of hair within the hair receiving channel. The discharge housing has a generally bent shape such that the airflow is redirected along the length of hair positioned in the hair receiving channel in a direction not parallel to the first direction.

BRIEF DESCRIPTION OF THE DRAWINGS

FIG. 1;

Corresponding reference characters indicate corresponding parts throughout the drawings.

DETAILED DESCRIPTION OF THE DRAWINGS

Figure 1:
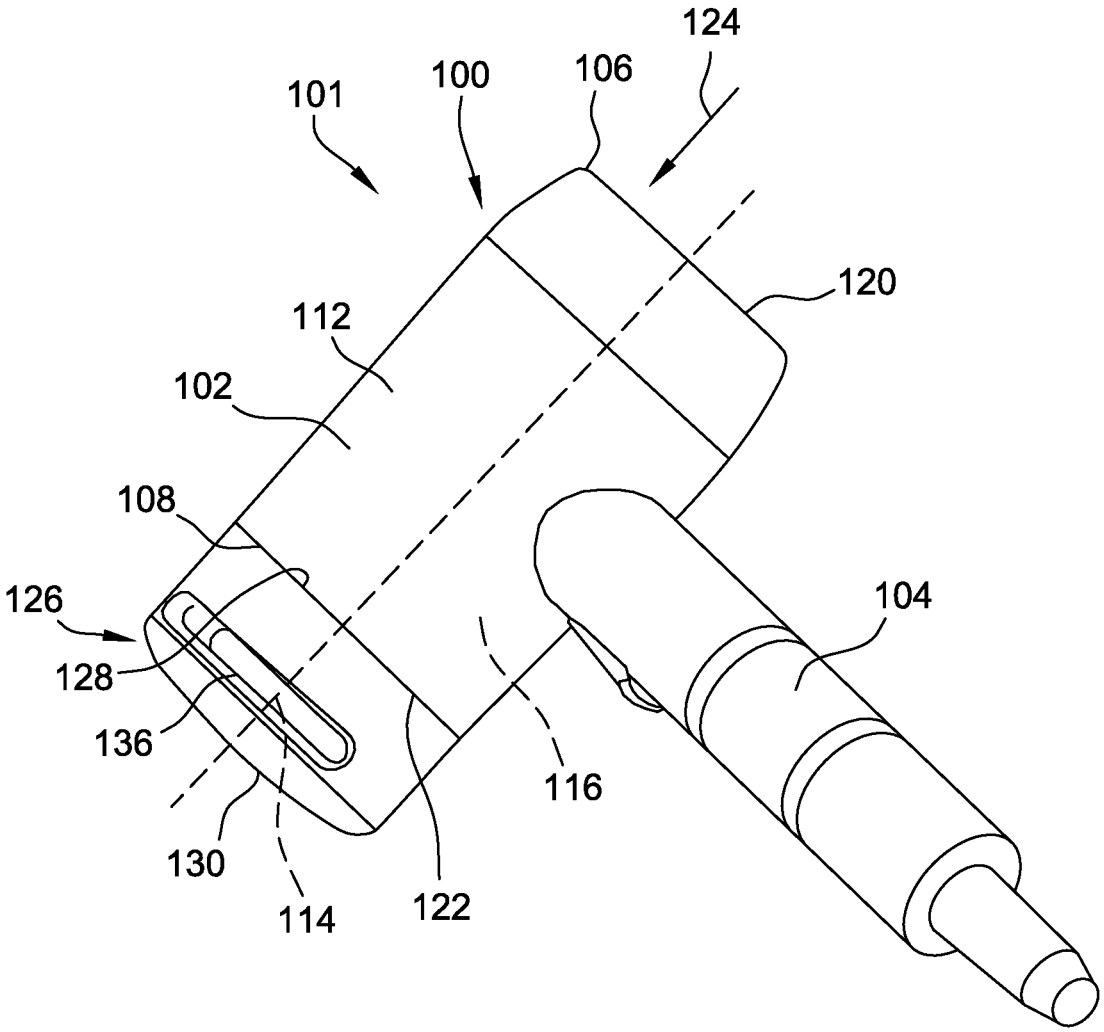
FIG. 1 is a perspective view of a first embodiment of a hair dryer having a discharge housing including a hair receiving channel.

Referring to the drawings, and in particular to FIG. 1, one embodiment of a hair dryer assembly is generally indicated at 101. The hair dryer assembly 101 includes a hair dryer, broadly an air-moving appliance, indicated at 100 and a discharge housing indicated at 126. The hair dryer 100 includes a body 102 and a handle 104. In general, the hair dryer 100 is adapted to direct heated air to hair to remove moisture from the hair. In some embodiments, the hair dryer 100 may include a user interface to enable a user to control the hair dryer 100. Suitable user interfaces include, for example and without limitation, screens, buttons, knobs, levers, and/or switches. The hair dryer 100 may have other suitable configurations without departing from the scope of this invention.

As shown in FIG. 1, the handle 104 extends from the body 102 and is configured to be held by a user during operation of the hair dryer 100. Accordingly, the hair dryer 100 seen in FIG. 1 is handheld. In the illustrated embodiment, the body 102 and the handle 104 are connected together to form a single housing assembly. In other embodiments, the hair dryer 100 may include other handles without departing from the scope of this disclosure.

In the illustrated embodiment, the body 102 includes a first (or rear) end 106, a second (or front) end 108, and a sidewall 112. The sidewall 112 extends from the first end 106 to the second end 108 about an axis 114. In addition, the sidewall 112 defines a cavity 116. In the illustrated embodiment, the sidewall 112 is generally cylindrical. In addition, in the illustrated embodiment, the sidewall 112 has a decreasing diameter between the first end 106 and the second end 108 such that the body 102 tapers between the first end 106 and the second end 108. In other suitable embodiments, the hair dryer 100 may include any suitable body 102 that enables the hair dryer 100 to operate as described herein.

The sidewall 112 defines an inlet 120 at the first end 106 for airflow 124 to enter the cavity 116. In addition, the sidewall 112 defines an outlet 122 at the second end 108 for the airflow 124 to exit the cavity 116. During operation, the hair dryer 100 draws the airflow 124 into the inlet 120, directs the airflow 124 through the cavity 116 along the axis 114, and discharges the airflow 124 through the outlet 122 in a direction parallel to the axis. In some suitable embodiments, the hair dryer 100 may include a grill extending across the inlet 120 and/or the outlet 122 to prevent objects passing through the inlet or the outlet. The hair dryer 100 may include other suitable inlets and/or outlets without departing from some aspects of the disclosure.

The hair dryer 100 may receive power from any suitable power source. For example, in some embodiments, the hair dryer 100 may include a power cord that connects to an external power source. In further embodiments, the hair dryer may be at least partially powered by an internal power source such as a battery.

In suitable embodiments, a fan (not shown in FIG. 1) may be positioned in the body 102 and driven by a motor (not shown in FIG. 1) to draw the airflow 124 into the inlet 120 and direct the airflow 124 through the cavity 116. In addition, one or more heating units (not shown in FIG. 1) may be positioned within the cavity 116. The heating units may be configured to increase the temperature of the airflow 124 prior to the airflow 124 being discharged through the outlet 122. In suitable embodiments, the heating units may have a power rating of about 1,000 watts to about 2,600 watts. In addition, the fan and the motor may be configured to discharge the airflow 124 at a desired rate. For example, the hair dryer 100 may be configured to discharge the airflow 124 at a rate in a range of about 10 cubic feet per minute to about 100 cubic feet per minute.

The hair dryer 100 may have any operating setting that enables the hair dryer to operate as described herein. For example, the motor may have two or more operating speeds. In addition, the hair dryer 100 may include different temperature settings. For example, in some embodiments, the hair dryer 100 may include a heating unit including two or more different temperatures settings. Moreover, the hair dryer 100 may be configured to deliver airflow 124 having a temperature at or below the temperature of the ambient environment, i.e., a cool stream.

In the illustrated embodiment, the discharge housing 126 is an attachment adapted for selective attachment to the second end 108 of the body 102 adjacent the outlet 122. The discharge housing 126 is configured to receive the airflow 124 being discharged from the body 102 of the hair dryer 100 through the outlet 122 and redirect the airflow towards hair. Specifically, in the illustrated embodiment, the discharge housing 126 is in the form of a concentrator configured to focus the airflow 124 on a portion of hair. The hair dryer assembly 101 may include other attachments such as a diffuser, a pick, a nozzle, a straightener, and any other suitable attachments. The attachments may be connected to the body 102 in any manner that enables the hair dryer assembly 101 to operate as described herein.

With reference to FIGS. 2-7, the discharge housing 126 includes a top 132, a bottom 134, a sidewall 136 extending between the top 132 and the bottom 134, and a channel wall 138. The channel wall 138 extends around an axis 146 and defines a hair receiving channel 148. Suitably, the channel wall 138 extends continuously around the hair receiving channel 148 such that hair within the channel is surrounded by the channel wall. The discharge housing 126 is configured to retain the hair within the hair receiving channel 148 during a hair styling operation and to direct the airflow 124 to hair within the hair receiving channel. Moreover, the discharge housing 126 is configured to distribute the airflow 124 more evenly throughout the hair than conventional hair dryers because the channel wall 138 completely surrounds the hair.

The discharge housing 126 has an inlet end 128 (FIG. 2) and a closed end 130 (FIG. 7) opposite the inlet end. The inlet end 128 is configured to releasably attach to the body 102 (shown in FIG. 1) of the hair dryer 100. For example, the discharge housing 126 may include one or more engagement features 140 (e.g., clips or projections) that are configured to engage corresponding engagement features of the body 102 (shown in FIG. 1). In other embodiments, the discharge housing 126 may be permanently attached to or formed with the body 102 such that the discharge housing 126 is not removable from the hair dryer 100.

The top 132, the bottom 134, and the sidewall 136 of the discharge housing 126 define a cavity 142 and an inlet 144 at the inlet end 128 for the airflow 124 to enter the cavity. The inlet 144 may be any suitable shape. In the illustrated embodiment, the inlet 144 is an elongate slot with curved sides. In other embodiments, the inlet 144 may be circular, ovular, rectangular, triangular, or any other suitable shape. The inlet 144 may have an area in a range of about 1.5 square centimeters ($cm^2$) to about 80 $cm^2$. The shape and size of the inlet 144 correspond to the shape and size of the outlet 122 of the body 102 (shown in FIG. 1) and facilitate the inlet receiving air from the outlet. Suitably, the inlet end 128 is substantially open, i.e., the inlet end 128 does not include a wall or panel extending across the inlet 144.

Figure 4:
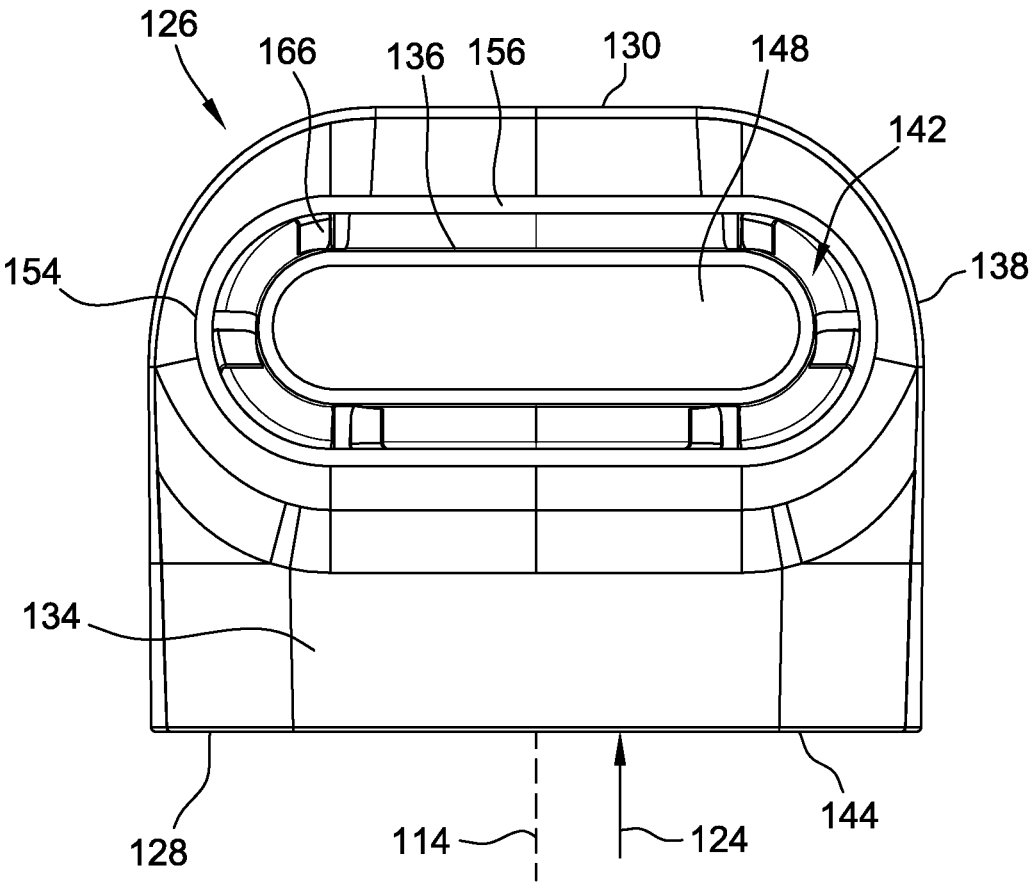
FIG. 4 is a bottom view of the discharge housing of FIG. 2.
Figure 5:
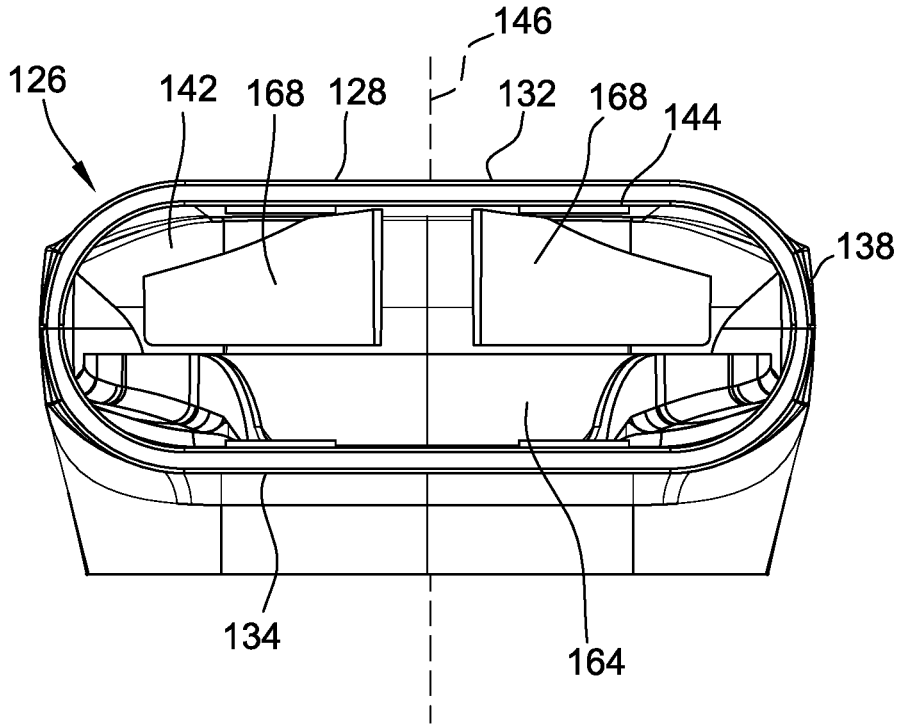
FIG. 5 is a front view of the discharge housing of FIG. 2.
Figure 6:
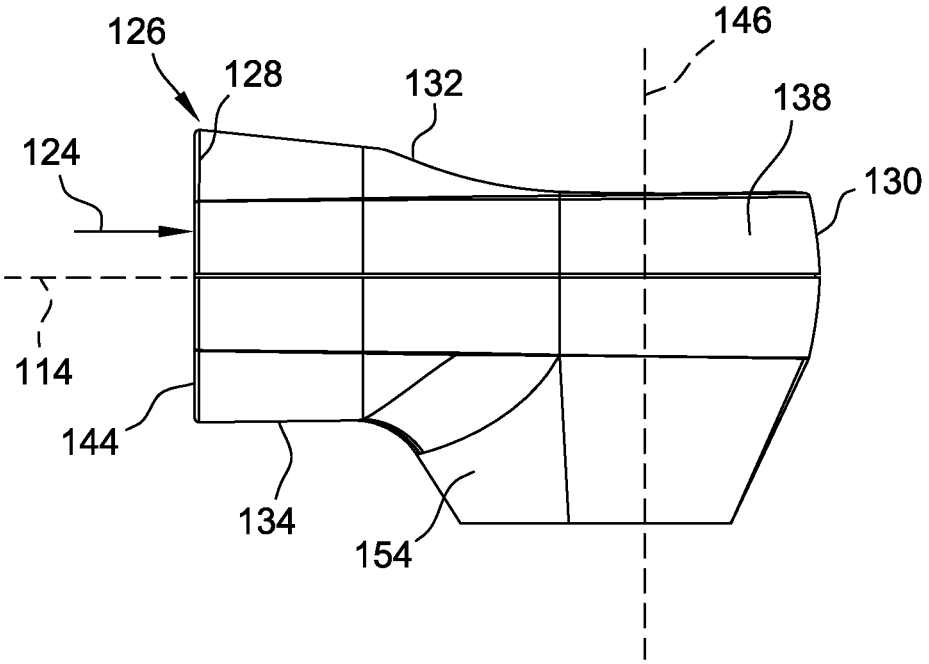
FIG. 6 is a right elevational view of the discharge housing of FIG. 2.
Figure 7:
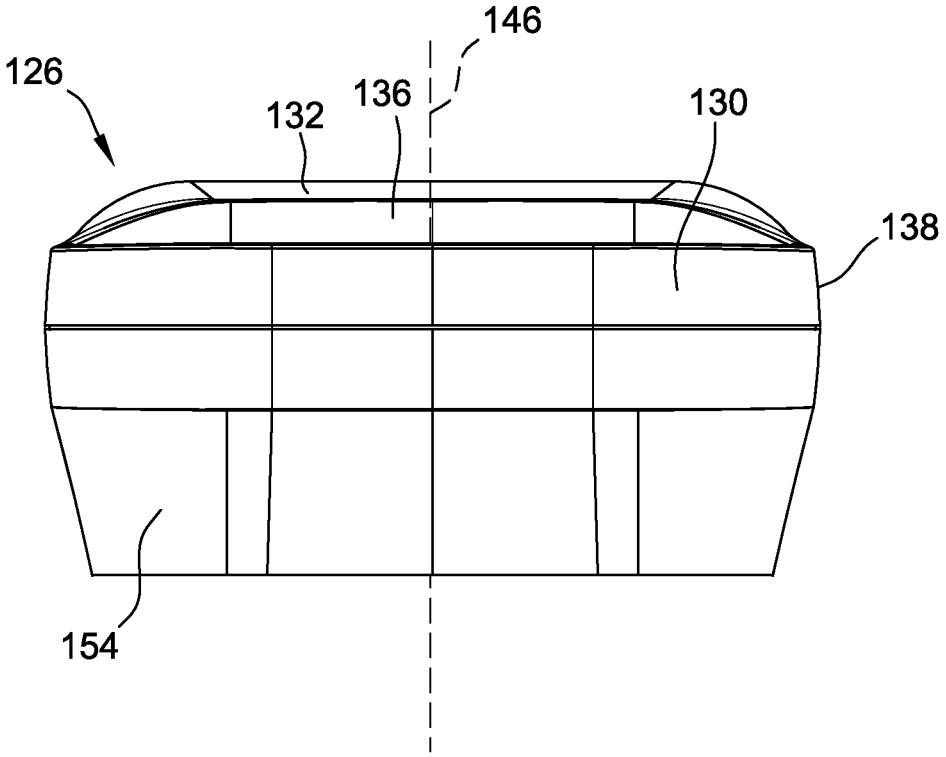
FIG. 7 is a rear view of the discharge housing of FIG. 2.

As seen in FIG. 4, the channel wall 138 at least partly defines an outlet 156 for airflow 124 to exit the discharge housing 126. The outlet 156 may be any suitable shape and size. For example, the outlet 156 may be circular, ovular, rectangular, triangular, or any other suitable shape. The outlet 156 may have an area in a range of about 1.5 cm 2 to about 80 $cm^2$.

Figure 2:
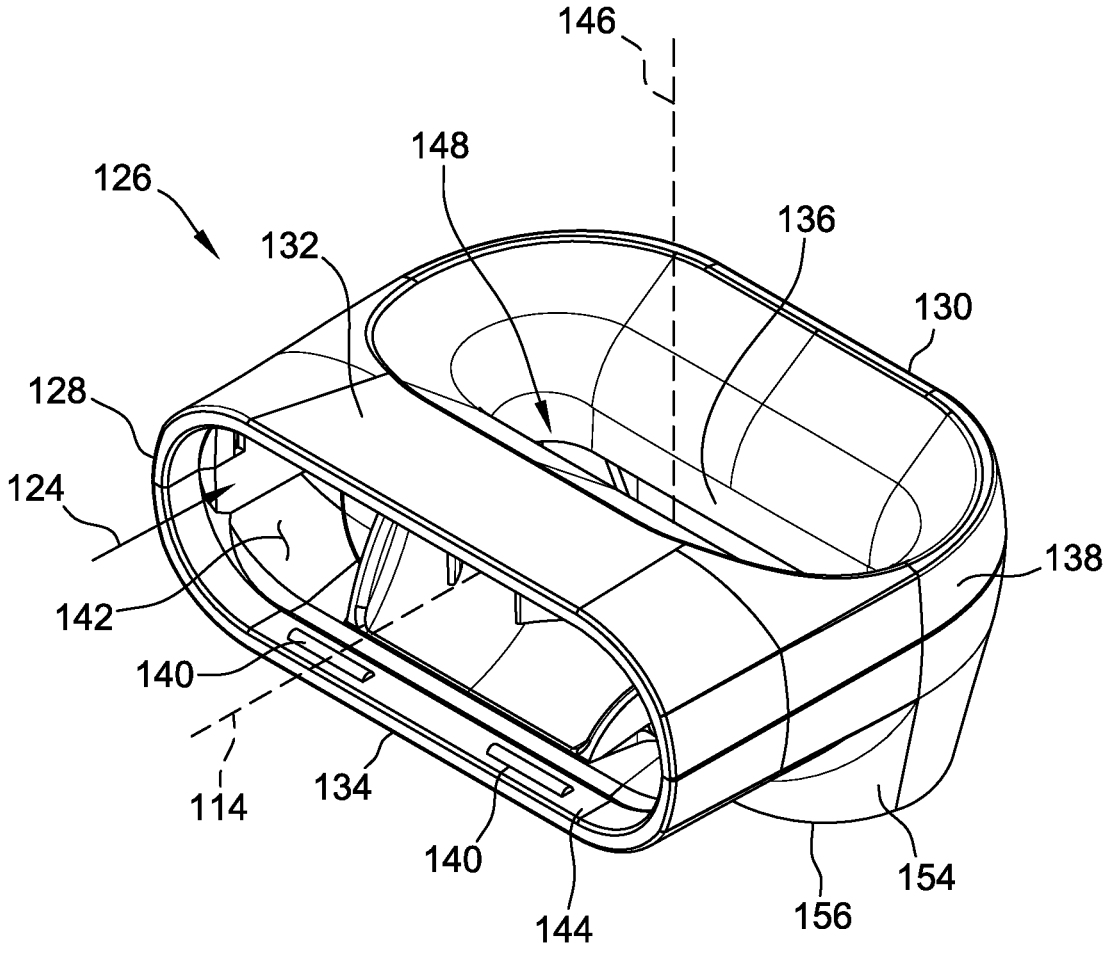
FIG. 2 is a perspective view of the discharge housing of the hair dryer of FIG. 3 is a top view of the discharge housing of FIG. 2.
Figure 3:
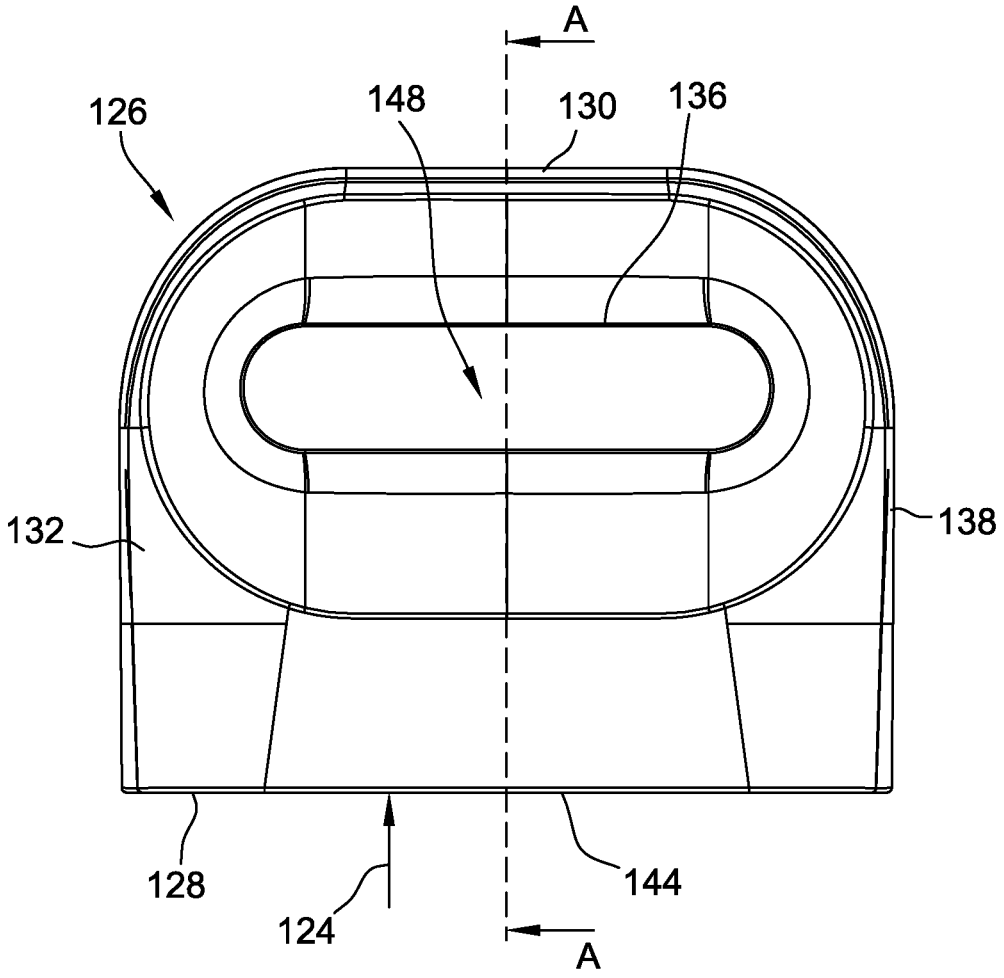

Also, at least a portion of the top 132, the bottom 134, and the sidewall 136 are substantially planar and extend from the inlet end 128 toward the channel wall 138 and are configured to direct the airflow 124 through the cavity 142 to the channel wall 138. The channel wall 138 extends downward from the top 132 intermediate the inlet end 128 and the closed end 130 and is configured to direct the airflow 124 in a direction generally perpendicular to the axis 114 (FIG. 2). In addition, the sidewall 136 is spaced radially outward from the channel wall 138 and extends at least partly around the channel wall to define an annular space. Accordingly, the discharge housing 126 is ring-shaped. In other embodiments, the discharge housing 126 may be rectangular, cylindrical, and/or any suitable shape.

The discharge housing 126 is configured to discharge the airflow out of the cavity 142 through the outlet 156 and towards the hair within the channel 148. For example, the outlet 156 is configured to direct the airflow 124 in a direction parallel to the axis 146 of the hair receiving channel 148 such that the airflow travels along the length of the hair positioned within the hair receiving channel. Accordingly, the discharge housing 126 forms a curved or bent flow path for the airflow 124 through the cavity 142 and the airflow is directed out of the outlet 156 in a direction that is substantially perpendicular to the direction of the airflow being drawn into the inlet 144.

Also, the discharge housing 126 includes a lip 154 that extends downward from the sidewall 136 and the bottom 134. The lip 154 is contiguous with a portion of the sidewall 136 and the lip 154 and the sidewall 136 define a continuous exterior surface of the discharge housing 126. In the illustrated embodiment, a front portion of the lip 154 extends at an angle relative to the bottom 134. The lip 154 may be curved to provide a smooth transition between the lip 154 and the bottom 134. The lip 154 extends downward and along the axis 146 and beyond the channel wall 138. In addition, the lip 154 tapers radially inward toward the channel wall 138 along the axis 146. Accordingly, the lip 154 may be configured to direct or funnel the airflow 124 that is discharged through the outlet 156 towards the hair within the hair receiving channel 148.

Figure 8:
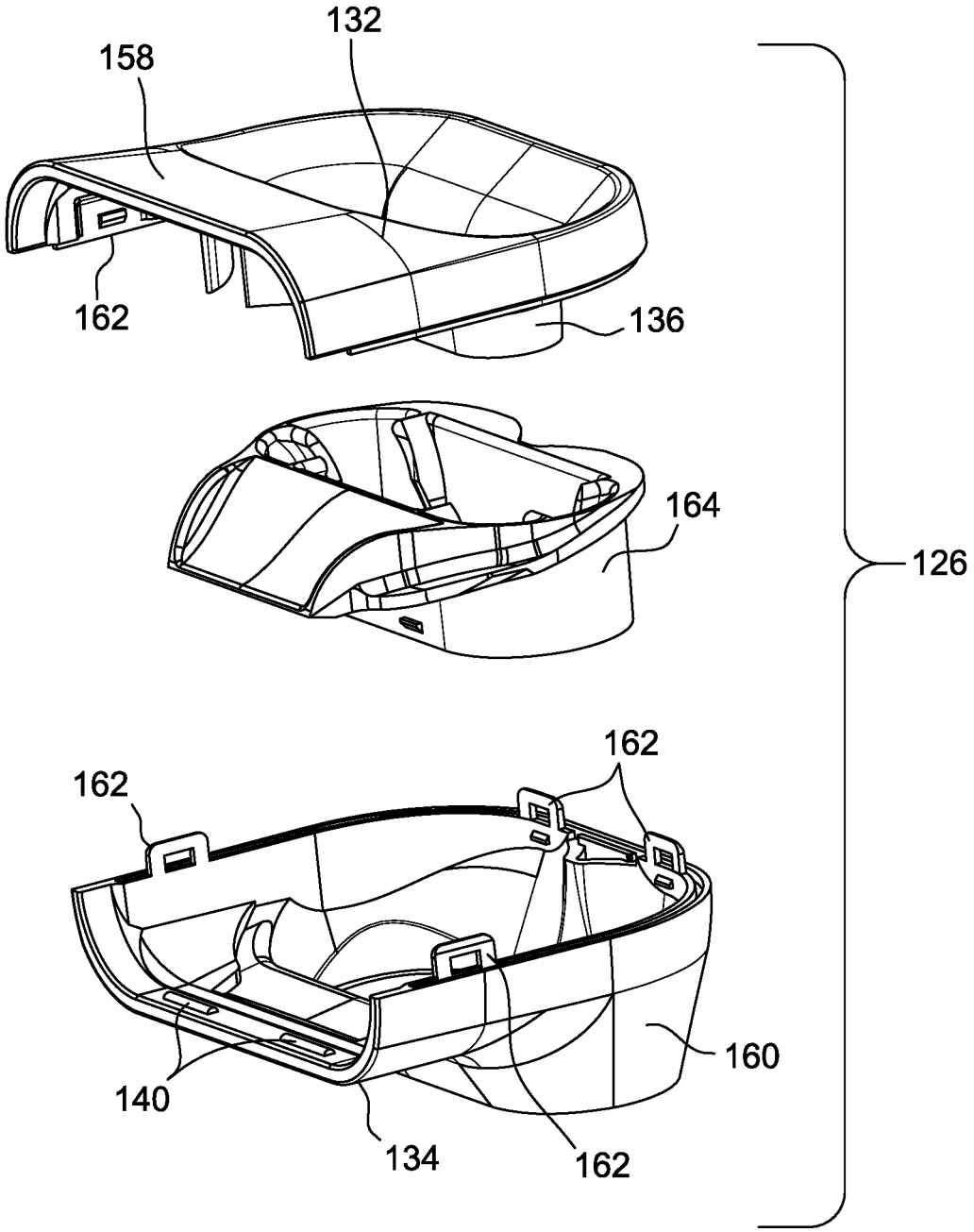
FIG. 8 is an exploded perspective view of the discharge housing of FIG. 2, the discharge housing including a flow guide positioned within a cavity of the discharge housing.

Referring now to FIG. 8, in the illustrated embodiment, the discharge housing 126 is constructed of at least two pieces (e.g., an upper piece 158 and a lower piece 160) that are connected together. For example, the pieces 158, 160 of the discharge housing 126 are connected together along the sidewall 136 and at the closed end 130 such that the cavity 142 is sealed along the sidewall and at the closed end. The pieces 158, 160 may be connected in any suitable manner. For example, in some embodiments, the pieces 158, 160 are integrally formed. In further embodiments, the pieces 158, 160 of the discharge housing 126 are formed separately and are fastened together. In the illustrated embodiment, the upper piece 158 and the lower piece 160 include corresponding engagement features 162 (e.g., projections and clips) that engage each other to secure the pieces together.

Figure 9:
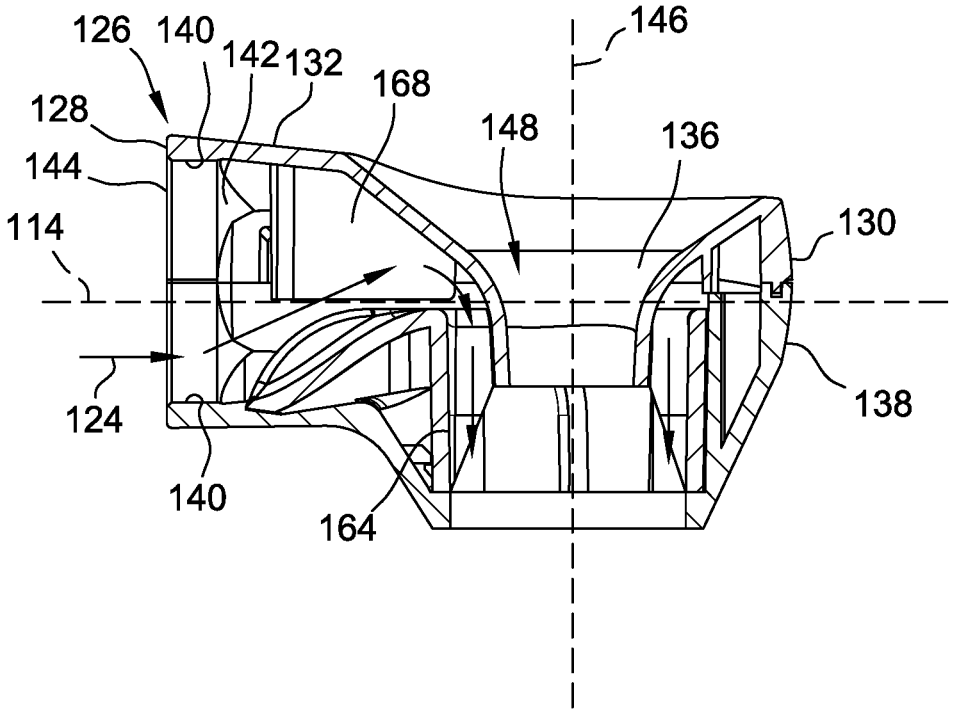
FIG. 9 is a cross-section of the discharge housing of FIG. 2 taken along section line A-A of FIG. 3 and showing airflow through the discharge housing.

As shown in FIGS. 8 and 9, the discharge housing 126 includes a flow guide 164 positioned within the cavity 142 to guide the airflow 124 through the cavity and towards the outlet 156. The flow guide 164 is sized and shaped to extend at least partly between the channel wall 138 and the sidewall 136 and between the channel wall 138 and the lip 154. The flow guide 164 may at least partly define the outlet 156. In addition, the flow guide 164 may include one or more ribs 166 to support the channel wall 138, the sidewall 136, and/or the lip 154. The flow guide 164 is curved and configured to guide airflow 124 along the curved flow path between the inlet 144 and the outlet 156. In addition, the flow guide 164 may be configured to direct the airflow 124 within the cavity 142 toward and around the outlet 156 such that the airflow is disbursed substantially evenly along the circumference of the hair receiving channel 148.

The discharge housing 126 may include one or more ramps 168 configured to direct the airflow 124 through the discharge housing 126 in conjunction with or instead of the flow guide 164. For example, in the illustrated embodiment, a pair of curved ramps 168 extend downward from the top 132. The ramps 168 extend along the top 132 at angles relative to the axis 114 along which the airflow 124 is received into the discharge housing 126 and the ramps 168 direct the airflow 124 around the channel wall 138 such that the airflow 124 is distributed evenly to the outlet 156.

With reference to FIG. 9, during operation, a section of hair may be positioned with the hair receiving channel 148. In suitable embodiments, the discharge housing 126 may be configured to generate a secondary airflow and draw the hair into the channel 148. For example, the airflow 124 may generate a negative pressure in the hair receiving channel 148 as the airflow 124 is discharged from the outlet 156 around the perimeter of the hair receiving channel. The hair that is near or in contact with the top 132 may be drawn and funneled into the hair receiving channel 148. In the illustrated embodiment, the top 132 and the channel wall 138 are curved or sloped along the axis 146 and taper radially inward relative to the axis 146 to guide hair into the hair receiving channel 148. When positioned within the hair receiving channel 148, the hair extends along the axis 146 and the channel wall 138 surrounds the hair in the hair receiving channel.

The hair dryer 100 (shown in FIG. 1) is operated to generate the airflow 124 that is discharged from the body 102 through the outlet 122. The discharge housing 126 receives the airflow 124 into the inlet 144, directs the airflow through the cavity 142, and discharges the airflow through the outlet 156. The airflow 124 may be redirected by the discharge housing 126 such that the airflow is discharged in a direction parallel to the axis of the hair positioned within the hair receiving channel 148. The airflow 124 discharged through the outlet 156 is directed towards the hair within the hair receiving channel 148. Suitably, the airflow 124 is distributed uniformly around the hair within the hair receiving channel 148. The hair dryer 100 (shown in FIG. 1) may be moved along the length of the hair to deliver the airflow 124 throughout the length of the hair. The discharge housing 126 maintains a desired position of the hair relative to the hair dryer 100 as the hair dryer is moved along the hair and provides for even distribution of the airflow 124 to the hair because the discharge housing maintains the hair within the hair receiving channel 148. In some embodiments, the edges of the discharge housing 126 are rounded to provide a smooth contact surface for the hair as the discharge housing is moved along the length of the hair. The airflow 124 contacts and moves along the length of hair positioned within the hair receiving channel 148. In some embodiments, the airflow 124 transfers heat to and/or removes moisture from the hair. Accordingly, the hair dryer assembly 101 may be used for a hair styling operation such as straightening hair using air entrainment for hair positioned within the hair receiving channel 148.

Figure 10:
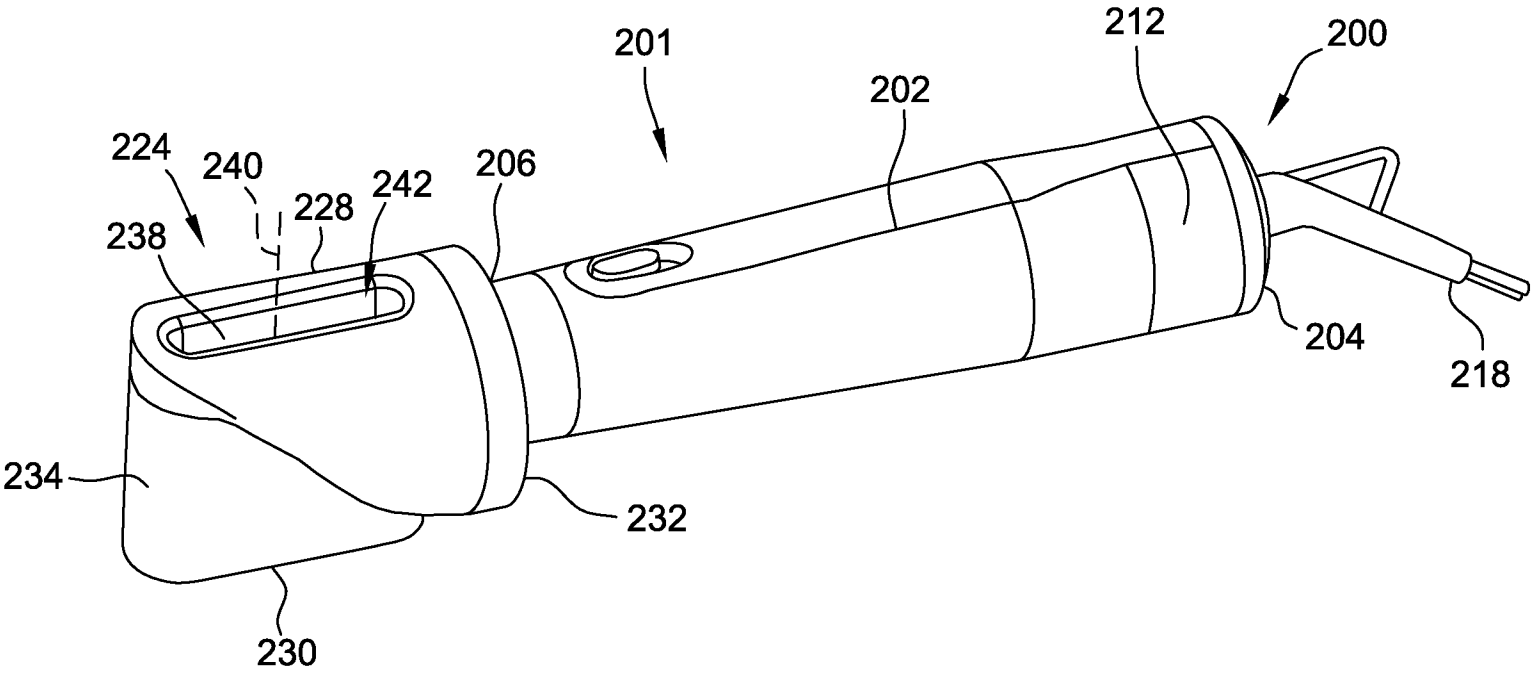
FIG. 10 is a perspective view of a second embodiment of a hair dryer including a discharge housing having a hair receiving channel.
Figure 11:
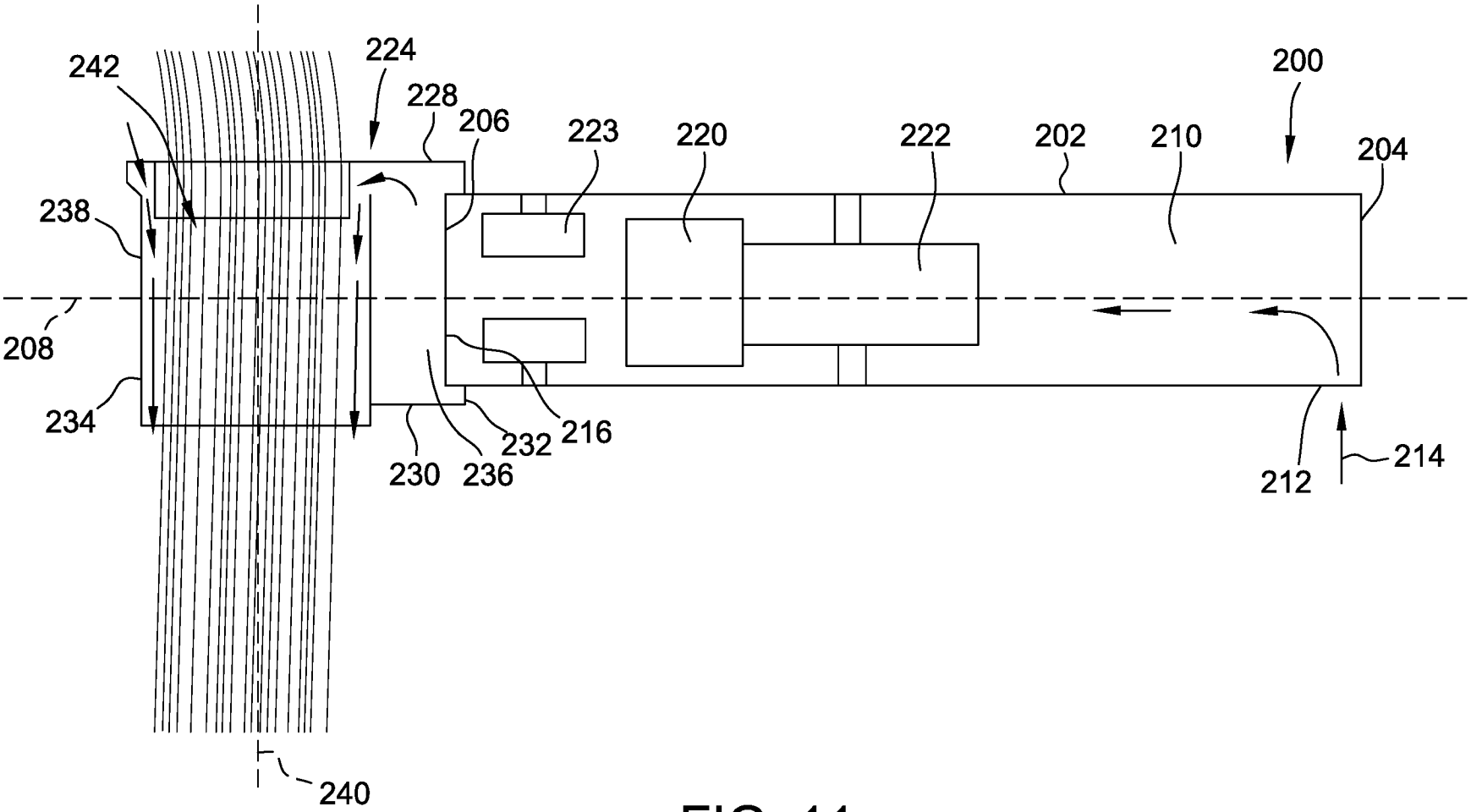
FIG. 11 is a sectional view of the hair dryer of FIG. 10 showing airflow through the hair dryer, the airflow being directed to hair positioned within the hair receiving channel.

Referring now to FIGS. 10 and 11, a second embodiment of a hair dryer assembly is generally indicated at 201. The hair dryer assembly 201 includes a hair dryer, broadly an air-moving appliance, indicated at 200 and a discharge housing indicated at 224. The hair dryer 200 includes a handle 202. The handle 202 has a first end 204 and a second end 206, and extends along a longitudinal axis 208. The handle 202 defines a cavity 210, an inlet 212 at the first end 204 for airflow 214 to enter the cavity, and an outlet 216 at the second end 206 for the airflow to exit the cavity. During operation, the hair dryer 200 draws the airflow 214 into the inlet 212, directs the airflow through the cavity 210 along the longitudinal axis 208, and discharges the airflow through the outlet 216 in a direction parallel to the longitudinal axis. In some suitable embodiments, the hair dryer 200 may include a grill extending across the inlet 212 and/or the outlet 216 to prevent objects passing through the inlet or the outlet. The hair dryer 200 may include other suitable inlets and/or outlets without departing from some aspects of the disclosure.

The hair dryer 200 may receive power from any suitable power source. For example, in some embodiments, the hair dryer 200 may include a power cord 218 that connects to an external power source. In further embodiments, the hair dryer 200 may be at least partially powered by an internal power source such as a battery.

In suitable embodiments, a fan 220 may be positioned in the handle 202 and driven by a motor 222 to draw the airflow 214 into the inlet 212 and direct the airflow through the cavity 210. In addition, one or more heating units 223 may be positioned within the cavity 210. The hair dryer 200 may have any operating setting that enables the hair dryer to operate as described herein. For example, the motor 222 may have two or more operating speeds. In addition, the hair dryer 200 may include different temperature settings. For example, in some embodiments, the hair dryer 200 may include a heating unit including two or more different temperatures settings. Moreover, the hair dryer 200 may be configured to deliver airflow 214 having a temperature at or below the temperature of the ambient environment, i.e., a cool stream.

The discharge housing 224 is attached to the second end 206 of the handle 202 of the hair dryer 200 adjacent the outlet 216. The discharge housing 224 is configured to receive the airflow 214 being discharged through the outlet 216 and redirect the airflow towards hair. In the illustrated embodiment, the discharge housing 224 is a concentrator and is adapted for selective attachment to the hair dryer 200. The hair dryer assembly 201 may include other attachments such as a diffuser, a pick, a nozzle, a straightener, and any other suitable attachments. The attachments may be connected to the handle 202 in any manner that enables the hair dryer assembly 201 to operate as described herein.

The discharge housing 224 includes a top 228, a bottom 230, an inlet end 232, and a closed end 234 opposite the inlet end. Also, the discharge housing 224 defines a cavity 236 for airflow 214 to travel through the discharge housing 224. The inlet end 232 is configured to releasably attach to the handle 202. The discharge housing 224 also includes a channel wall 238 extending around an axis 240 and defining a hair receiving channel 242. Suitably, the channel wall 238 extends continuously around the hair receiving channel 242 and the hair within the channel is surrounded by the channel wall. The discharge housing 224 is configured to retain hair within the hair receiving channel 242 during a hair styling operation and direct airflow 214 to portions of hair within the hair receiving channel.

The discharge housing 224 is attached to the second end 206 of the handle 202 of the hair dryer 200 and extends along the longitudinal axis 208 of the handle. In the illustrated embodiment, the handle 202 is a cylinder and the hair dryer 200 is configured as a wand. As a result, the hair dryer assembly 201 is compact and the hair dryer assembly may be simpler for at least some users to manipulate than at least some conventional hair dryers.

Figure 12:
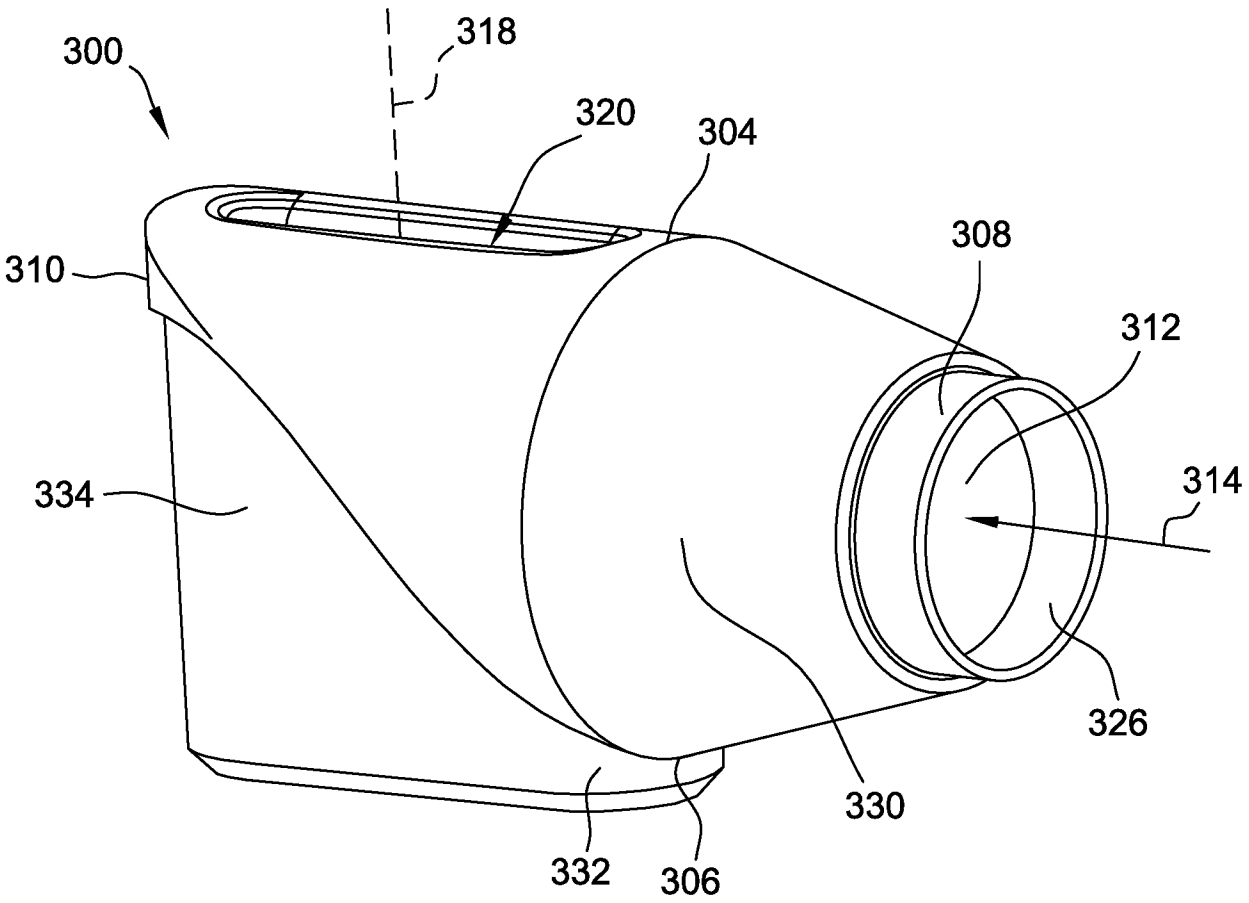
FIG. 12 is a perspective view of another embodiment of a discharge housing for use with a hair dryer such as the hair dryers of FIGS. 1 and 10.
Figure 13:
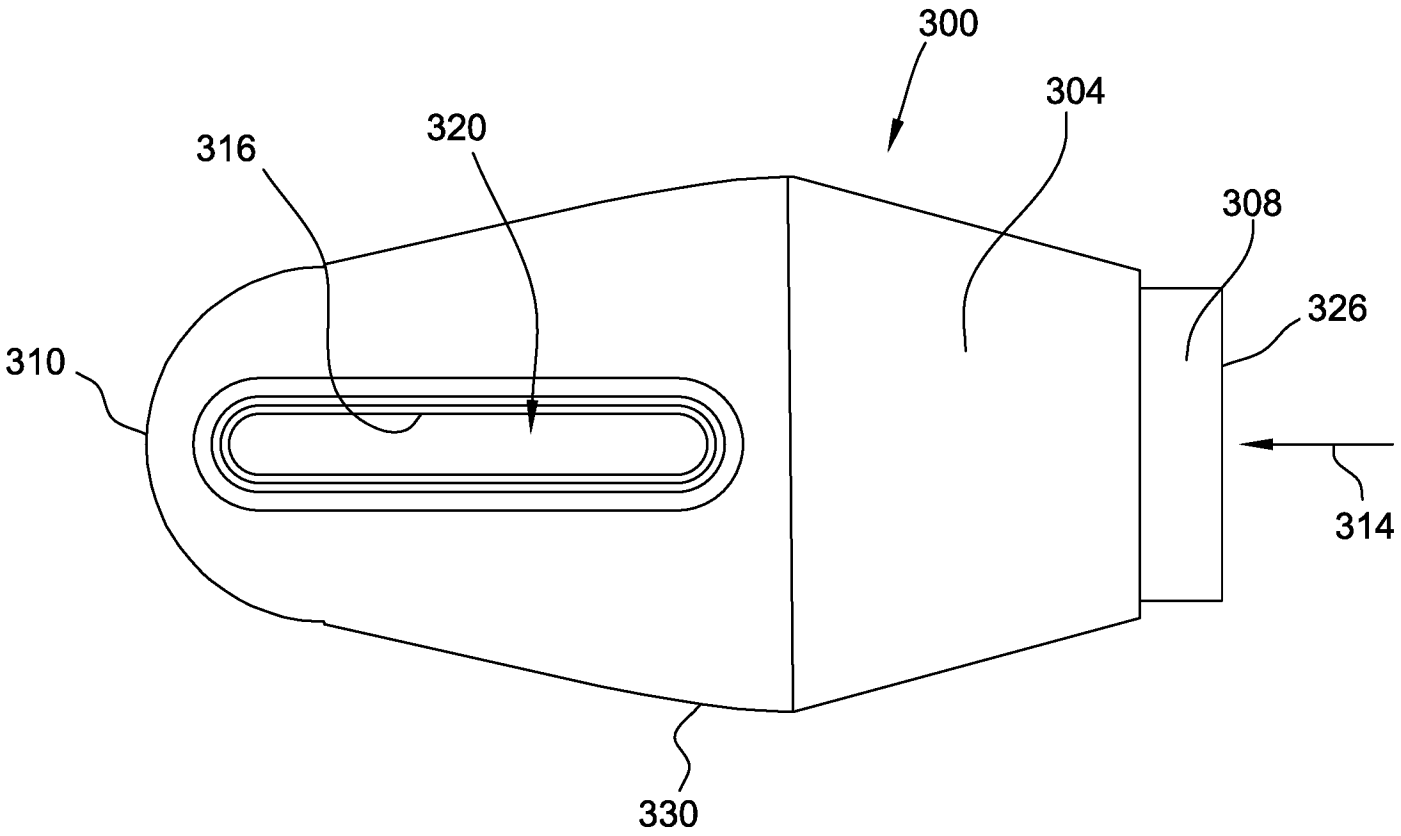
FIG. 13 is a top view of the discharge housing of FIG. 12.
Figure 14:
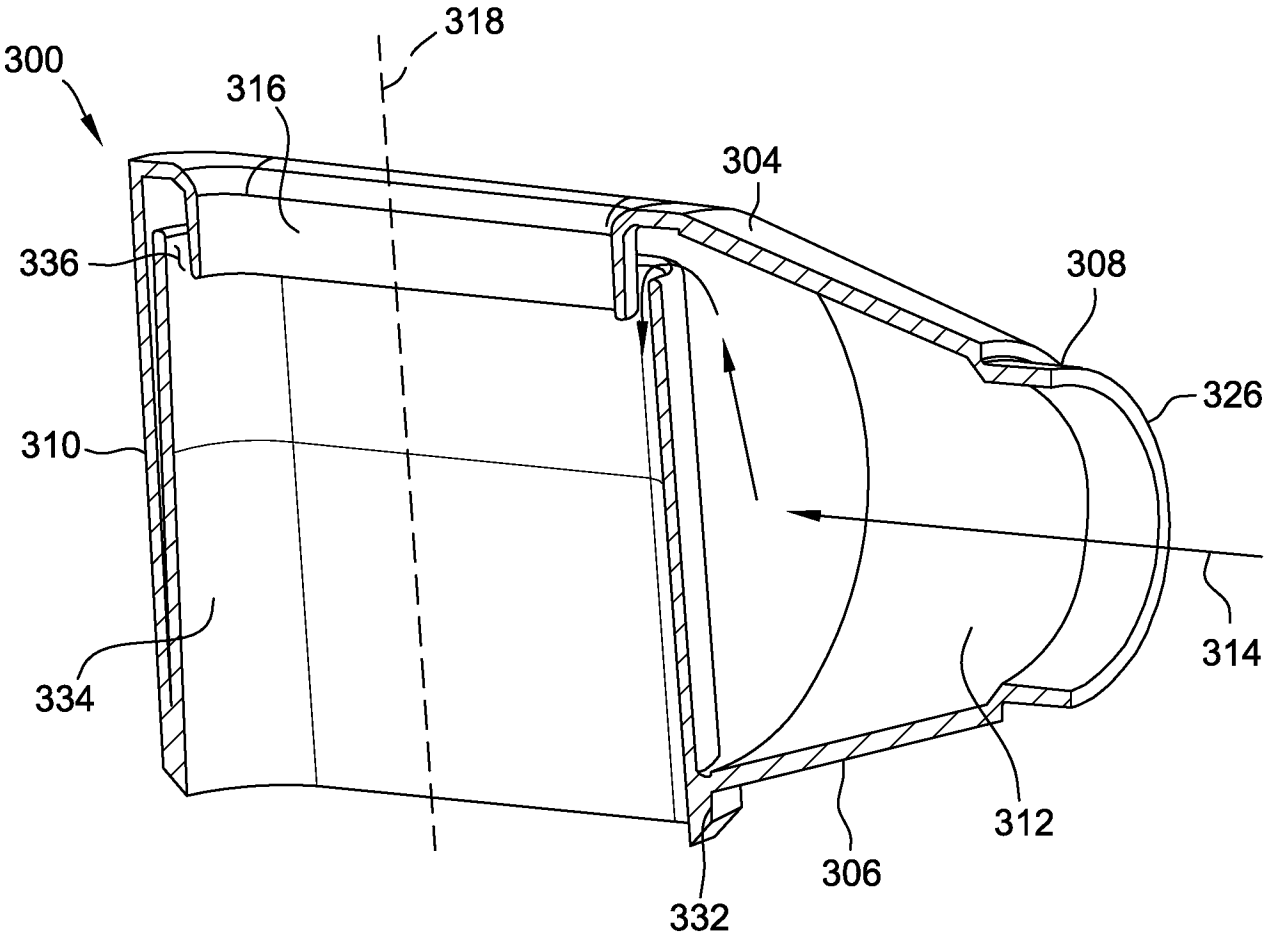
FIG. 14 is a sectional view of the discharge housing of FIG. 12.

In reference to FIGS. 12-14, another embodiment of a discharge housing for use with the hair dryer 100 (shown in FIG. 1) or the hair dryer 200 (shown in FIG. 12) is generally indicated at 300. The discharge housing 300 includes a top 304, a bottom 306, an inlet end 308, and a closed end 310 opposite the inlet end. The inlet end 308 is configured to releasably attach to the body 102 of the hair dryer 100 (shown in FIG. 1) or the handle 202 of the hair dryer 200 (shown in FIG. 12) to receive airflow 314. The top 304 and the bottom 306 at least partly define an inlet 326 at the inlet end 308 for the airflow 314 to enter the discharge housing 300. Also, the discharge housing 300 defines a cavity 312 for the airflow 314 to travel through the discharge housing 300.

The top 304 and the bottom 306 are connected at the closed end 310 such that the cavity 312 is sealed at the closed end. The top 304 and the bottom 306 may be connected in any suitable manner. For example, in some embodiments, the top 304 and the bottom 306 are integrally formed. In further embodiments, the top 304 and the bottom 306 are formed separately and are fastened together. In the illustrated embodiment, the top 304 and the bottom 306 are integrally formed as a single piece.

In addition, the discharge housing 300 includes a channel wall 316. In the illustrated embodiment, the channel wall 316 extends downward from the top 304 around an axis 318 and at least partly defines a hair receiving channel 320. Suitably, the channel wall 316 extends continuously around the hair receiving channel 320 such that hair within the channel is surrounded by the channel wall. As a result, the discharge housing 300 is configured to retain hair within the hair receiving channel 320 during a hair styling operation and the discharge housing is configured to direct airflow 314 to hair within the hair receiving channel.

The discharge housing 300 also includes a sidewall 330 extending at least partly around the channel wall 316 and spaced radially outward from the channel wall 316. In addition, the top 304 extends between the channel wall 316 and the sidewall 330. Accordingly, the discharge housing 300 is at least partly ring-shaped. The top 304 and the channel wall 316 are curved or sloped along the axis 318 and taper radially inward relative to the axis 318 to guide hair into the hair receiving channel 320. In other embodiments, the discharge housing 300 may be rectangular, cylindrical, and/or any suitable shape.

Also, the discharge housing 300 includes a lip 332 that extends downward from the bottom 306 and a collar 334 that extends upward from the bottom and at least partly around the channel wall 316. The collar 334 and the channel wall 316 at least partly define an outlet 336 for airflow 314 to exit the discharge housing 300. The outlet 336 is configured to direct the airflow out of the discharge housing 300 and towards the hair within the channel 320. For example, the outlet 336 is configured to direct the airflow 314 in a direction parallel to the axis 318 of the hair receiving channel 320 such that the airflow travels along the length of the hair positioned within the hair receiving channel. Suitably, the discharge housing 300 defines a curved flowpath for the airflow 314 such that the airflow is directed out of the outlet 336 in a direction that is different from the direction of the airflow when it is received through the inlet 326.

As shown in FIG. 14, during operation, the discharge housing 300 receives the airflow 314 into the inlet 326, directs the airflow through the cavity 312, and discharges the airflow through the outlet 336. Hair is positioned within the hair receiving channel 320 and the discharge housing 300 directs the airflow 314 out of the outlet 336 towards the hair.

Figure 15:
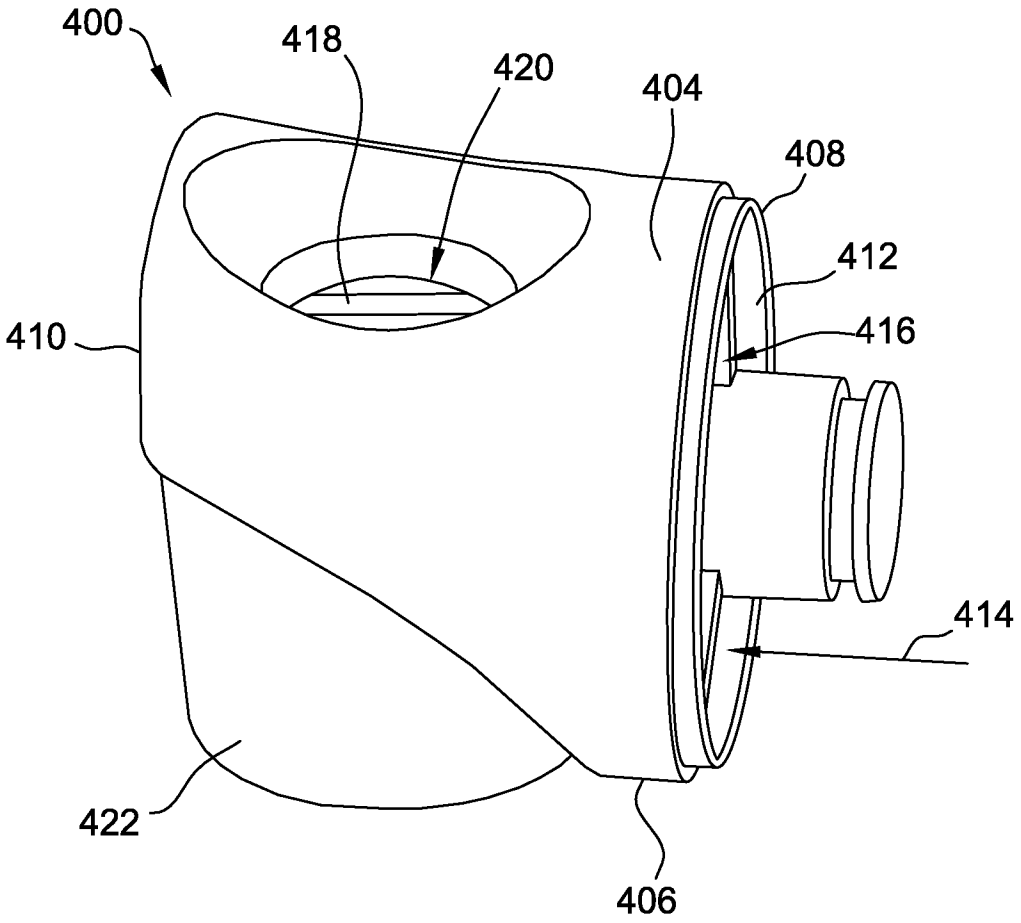
FIG. 15 is a perspective view of yet another embodiment of a discharge housing for use with a hair dryer such as the hair dryers of FIGS. 1 and 10, the discharge housing having a compact shape.
Figure 16:
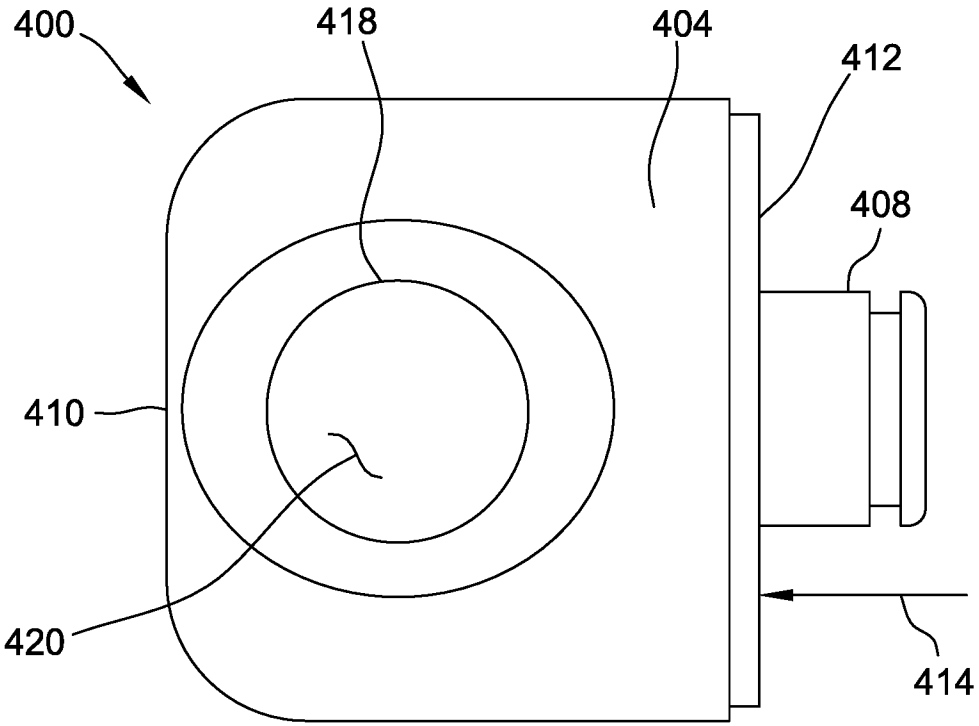
FIG. 16 is a top view of the discharge housing of FIG. 15.

In reference to FIGS. 15 and 16, yet another embodiment of a discharge housing for use with the hair dryer 100 (shown in FIG. 1) or the hair dryer 200 (shown in FIG. 12) is generally indicated at 400. The discharge housing 400 includes a top 404, a bottom 406, an inlet end 408, and a closed end 410 opposite the inlet end. The inlet end 408 is configured to releasably attach to the body 102 of the hair dryer 100 (shown in FIG. 1) or the handle 202 of the hair dryer 200 (shown in FIG. 12). The discharge housing 400 defines an inlet 412 configured to receive airflow 414 and a cavity 416 for the airflow to travel through the discharge housing 400.

The discharge housing 400 includes a channel wall 418 defining a hair receiving channel 420 and a collar 422 that is spaced radially outward from and extends at least partly along the channel wall 418. Overall, the discharge housing 400 has a generally rectangular cuboid shape. The hair receiving channel 420 is positioned substantially in the middle of the discharge housing 400. As a result, the discharge housing 400 may be more compact than other housings. In addition, the airflow 414 that is drawn into the discharge housing 400 is immediately redirected towards the outlet of the discharge housing and heat loss of the airflow 414 as the airflow 414 moves through the discharge housing 400 may be reduced.

Figure 17:
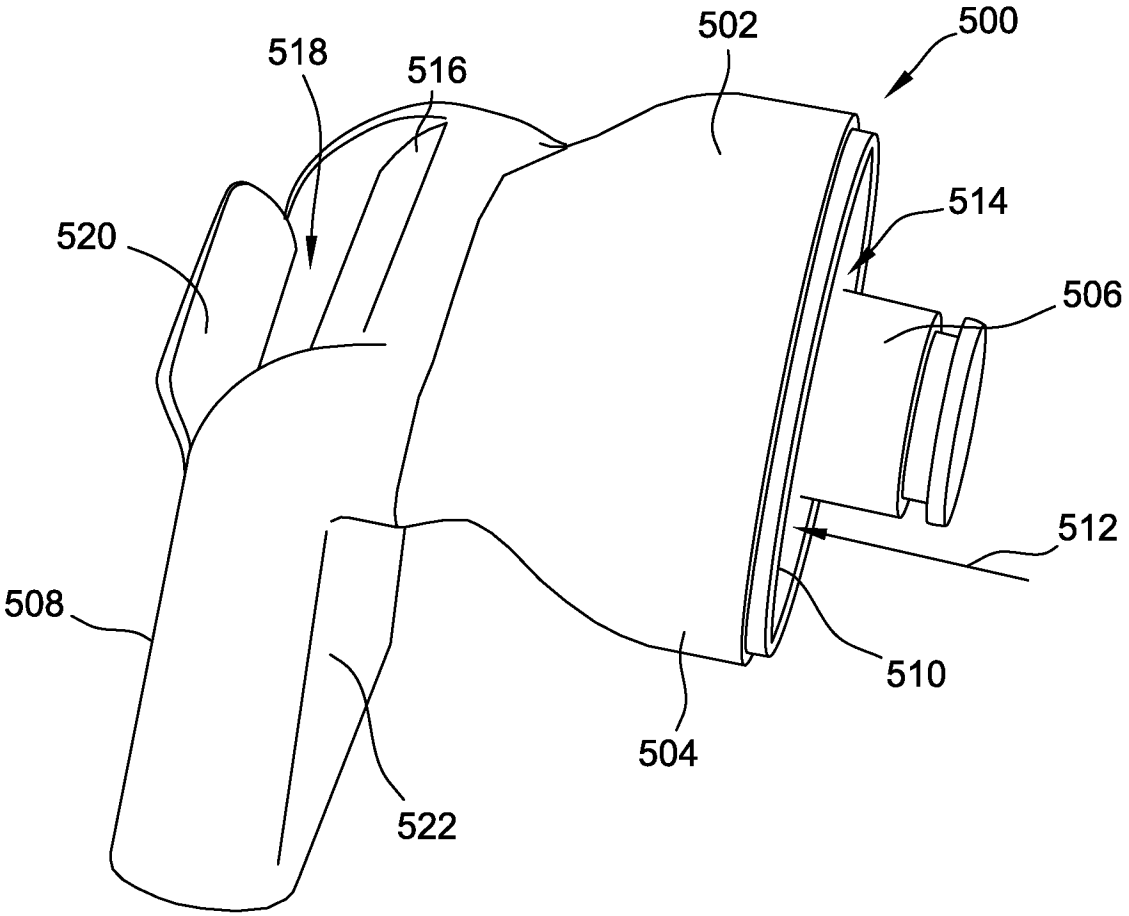
FIG. 17 is a perspective view of still another embodiment of a discharge housing for use with a hair dryer such as the hair dryers of FIGS. 1 and 10, the discharge housing having an L-shape.
Figure 18:
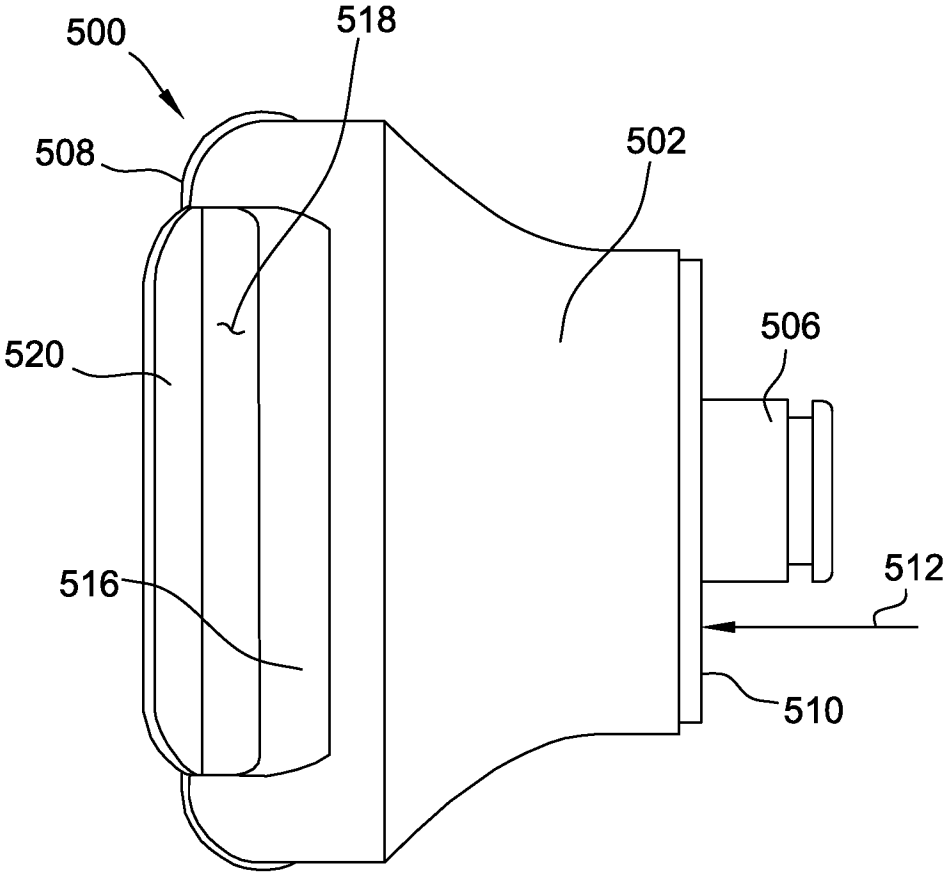
FIG. 18 is a top view of the discharge housing of FIG. 17.

In reference to FIGS. 17 and 18, still another embodiment of a discharge housing for use with the hair dryer 100 (shown in FIG. 1) or the hair dryer 200 (shown in FIG. 12) is generally indicated at 500. The discharge housing 500 includes a top 502, a bottom 504, an inlet end 506, and a closed end 508 opposite the inlet end. The discharge housing 500 defines an inlet 510 at the inlet end 506 configured to receive airflow 512 and a cavity 514 for the airflow to travel through the discharge housing 500. The inlet end 506 is configured to releasably attach to the body 102 of the hair dryer 100 (shown in FIG. 1) or the handle 202 of the hair dryer 200 (shown in FIG. 12).

The discharge housing 500 includes a channel wall 516 defining a hair receiving channel 518. In addition, the discharge housing 500 includes a flange 520 that extends upward from the top 502 along the hair receiving channel 518. The flange 520 guides hair into the hair receiving channel 518 to reduce stress points on the hair and prevent damage to the hair. The discharge housing 500 also includes a collar 522 that is spaced radially outward from and extends at least partly along the channel wall 516. The collar 522 directs airflow 512 discharged from the discharge housing 500 along hair positioned within the hair receiving channel 518. Overall, the discharge housing 500 is generally bent or L-shaped. Accordingly, the airflow 512 that is drawn into the discharge housing 500 is redirected along the length of hair positioned in the hair receiving channel 518.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An attachment for a hair dryer configured to receive airflow from the hair dryer and redirect the airflow, the attachment comprising:

a connector housing extending along an axis;

an inlet end defining an inlet for the airflow to enter the attachment in a first direction parallel to the axis of the connector housing;

an outlet end defining a slot-shaped outlet for the airflow to exit the attachment in a direction not parallel to the first direction; and a channel wall defining a hair receiving channel and extending at least partly around the hair receiving channel such that hair within the hair receiving channel is contacted by the channel wall, wherein the channel wall extends downflow from the outlet end in a direction not parallel to the first direction and is configured to direct the airflow along a length of hair within the hair receiving channel.

2. The attachment as set forth in claim 1, wherein the attachment is bent in a general L-shape or hook shape.

3. The attachment as set forth in claim 1, further comprising a top extending between the inlet end and the outlet end and a bottom opposite the top.

4. The attachment as set forth in claim 3, further comprising a cavity defined between the top and the bottom.

5. The attachment as set forth in claim 3, further comprising a guide surface on the top, the guide surface extending along the hair receiving channel and configured to guide hair into the hair receiving channel.

6. The attachment as set forth in claim 1, wherein the channel wall is curved.

7. The attachment as set forth in claim 1, wherein the channel wall defines the slot-shaped outlet of the outlet end.

8. A hair dryer assembly comprising:

a hair dryer configured to output an airflow; and an attachment configured to receive the airflow from the hair dryer, wherein the attachment comprises:

a connector housing extending along an axis;

an inlet end defining an inlet for the airflow to enter the attachment in a first direction parallel to the axis of the connector housing;

an outlet end defining a slot-shaped outlet for the airflow to exit the attachment in a direction not parallel to the first direction; and a channel wall defining a hair receiving channel and extending at least partly around the hair receiving channel such that hair within the hair receiving channel is received and contacted by the channel wall, wherein the channel wall extends downflow from the outlet end in a direction not parallel to the first direction and is configured to direct the airflow along a length of hair within the hair receiving channel.

9. The hair dryer assembly as set forth in claim 8, wherein the attachment is releasably attached to the hair dryer.

10. The hair dryer assembly as set forth in claim 8, wherein the attachment is bent in a general L-shape or hook shape.

11. The hair dryer assembly as set forth in claim 8, wherein the attachment further comprises a top extending between the inlet end and the outlet end and a bottom opposite the top.

12. The hair dryer assembly as set forth in claim 11, wherein the attachment further comprises a cavity defined between the top and the bottom.

13. The hair dryer assembly as set forth in claim 11, wherein the attachment further comprises a guide surface on the top, the guide surface extending along the hair receiving channel and configured to guide hair into the hair receiving channel.

14. The hair dryer assembly as set forth in claim 8, wherein the channel wall of the attachment is curved.

15. The hair dryer assembly as set forth in claim 8, wherein the channel wall of the attachment defines the slot-shaped outlet of the outlet end.

16. A discharge housing for a hair dryer, the discharge housing comprising:

a cylindrical connector that is configured to releasably connect to the hair dryer;

an inlet end defining an annular inlet extending around the cylindrical connector and configured for airflow to enter the attachment in a first direction;

an outlet end defining an outlet for airflow to exit the attachment;

a top extending between the inlet end and the outlet end;

a bottom opposite the top and extending between the inlet end and outlet end, wherein the top and the bottom collectively define a cavity and are sloped toward each other along at least a portion of the extension between the inlet end and outlet end such that the cavity has a tapered shape;

a hair contact wall extending at least in part downward from the outlet end in a direction not parallel to the first direction; and a pair of opposed sidewalls extending along sides of the hair contact wall, the hair contact wall and the sidewalls defining a hair receiving channel and extending at least partly around the hair receiving channel, wherein the hair contact wall is arranged such that hair within the hair receiving channel is contacted by the hair contact wall, wherein the hair contact wall extends downflow from the outlet end and is configured to direct the airflow and along a length of hair within the hair receiving channel, wherein the discharge housing has a generally bent shape such that the airflow is redirected along the length of hair positioned in the hair receiving channel in a direction not parallel to the first direction.

* * * * *